US006708379B1

(12) United States Patent
Wilson

(10) Patent No.: US 6,708,379 B1
(45) Date of Patent: Mar. 23, 2004

(54) FASTENING DEVICE AND METHOD FOR MATERIAL HAVING A MESH

(76) Inventor: Eric P. Wilson, 259 Center St., W., Warren, OH (US) 44481

( * ) Notice: Subject to any disclaimer, the term of this patent is extended or adjusted under 35 U.S.C. 154(b) by 0 days.

(21) Appl. No.: 10/217,315

(22) Filed: Aug. 9, 2002

(51) Int. Cl.[7] ..... A44B 17/00; A44B 18/00; B21F 27/00

(52) U.S. Cl. ..... 24/452; 24/442; 24/446; 24/584.1; 24/586.11; 359/443

(58) Field of Search ..... 24/452, 442, 446, 24/586.1, 586.11, 585.1; 160/237; 264/167; 359/443

(56) References Cited

U.S. PATENT DOCUMENTS

| | | | | | |
|---|---|---|---|---|---|
| 2,499,898 | A | * | 3/1950 | Anderson | 24/442 |
| 3,192,589 | A | | 7/1965 | Pearson | |
| 4,222,162 | A | | 9/1980 | Levy et al. | |
| 4,290,174 | A | | 9/1981 | Kallerberg | |
| 4,760,980 | A | | 8/1988 | Sharpe | |
| 4,875,259 | A | * | 10/1989 | Appeldorn | 24/584.1 |
| 5,077,870 | A | | 1/1992 | Melbye et al. | |
| 5,101,539 | A | * | 4/1992 | Kennedy et al. | 24/442 |
| 5,103,339 | A | * | 4/1992 | Broome | 359/443 |
| 5,201,101 | A | * | 4/1993 | Rouser et al. | 24/586.11 |
| 5,212,855 | A | * | 5/1993 | McGanty | 24/585.1 |
| 5,634,245 | A | * | 6/1997 | Rouser et al. | 24/452 |
| 5,657,516 | A | * | 8/1997 | Berg et al. | 24/452 |
| 5,819,391 | A | | 10/1998 | Matsushima et al. | |
| 5,845,375 | A | | 12/1998 | Miller et al. | |
| 6,006,923 | A | | 12/1999 | Helmy et al. | |
| 6,027,079 | A | | 2/2000 | Santoro | |
| 6,112,377 | A | | 9/2000 | Wilson | |
| 6,223,401 | B1 | * | 5/2001 | D'Sa et al. | 24/452 |

* cited by examiner

*Primary Examiner*—Victor Sakran
(74) *Attorney, Agent, or Firm*—Robert J. Herberger

(57) ABSTRACT

A fastening device comprising a pair of attachment pads, one pad having a surface from which stems project, a second pad formed with openings and receptacles, each opening and receptacle adapted to receive a stem, the pads becoming interlocked by the fit of the stems in the receptacles. A woven, knit or knotted material of open texture having holes, preferable evenly spaced holes such as those of a screen or net, is secured between the pads by passing the stems through the mesh and into the receptacles. The pads and mesh material, so arranged, are secured to a structure by a bracket or clamp that is fixed to the attachment pads and mesh material.

15 Claims, 3 Drawing Sheets

FASTENING DEVICE AND METHOD FOR MATERIAL HAVING A MESH

BACKGROUND OF THE INVENTION

1. Field of the Invention

This invention relates to the field of devices for fastening or connecting material having a mesh. More particularly, the invention pertains to such devices for securing screen material to a structure.

2. Description of the Prior Art

Fasteners are used in a variety of applications, including construction, machinery, medical equipment, business activities and the textile industry. Commonly known fasteners range from rivets, snaps and buttons to VELCRO® (a registered trademark of Velcro USA, Inc.), and they usually involve a two-piece assembly for joining two articles together. Furthermore, fasteners such as rivets and snaps employ a male and female component.

Various technologically advanced two-piece fasteners having interlocking members other than male and female components are known. For example, U.S. Pat. No. 6,112,377 describes a fastening device comprising a pair of attachment pads, each pad having a face formed with mushroom-shaped interlocking members, which are uniformly spaced so that the mushroom-shaped members of one attachment pad interlock with the mushroom-shaped members of the opposing attachment pad. The interlocking members of the attachment pads securely engage a screen material having a mesh corresponding with the spaced relation of the interlocking members.

U.S. Pat. No. 5,819,391 describes a fastener having a substrate with engaging elements projecting from its surface, the elements stabilized and supported by an elastic material located around the elements and below each element head. A sheet perforated with holes snaps over the heads of the elements to complete the fastener.

Other techniques for attaching woven shade screen to supporting structure include forming a hem at the edge of the screen, fixing eyelets to the hem along the material's edge, inserting a attachment through the eyelet, and connecting attachment and screen to a supporting member. The fastener may include an elastic cord formed with a loop and having a weighted ball attached to the end of the cord. The cord fits through the eyelet and wraps around a supporting member and is fastened to the ball. Unfortunately this technique is limited to a predetermined, spaced location of the eyelet, which is applied to the screen at fixed intervals at a factory, without regard to the location of the supporting structure and without reference to the need to support the screen at locations other than at the eyelets. It is preferred that the screen be supported according to the needs of the user by placing fasteners at various spaced intervals and without damaging the screen.

Although many of the fasteners known in the prior art perform satisfactorily in their particular applications, they are deficient in other applications. For example, fasteners that are secured to articles only through an adhesive backing fail if lint accumulates on the adhesive. Fasteners sewn onto the material being supported can fall off the article when thread breaks or becomes unstitched. Similar problems occur in screen applications, particularly when securing screens in windows. Problems occur when part of the screen fastener detaches from the screen due to repeated use. Common fasteners in the prior art are often cumbersome to use. It can also be burdensome when trying to obtain a secure fit between the screen and a window frame.

Such common fasteners also present problems when a screen needs to be covered with another material such as clear plastic or nylon to protect against inclement weather or very small insects. In order to cover the screen, separate fastening units are needed to secure the covering material in place.

A preferred fastener and method of its use would involve engaging a screen between two interlocking attachment pads, whose location on the screen can be easily and quickly changed for a more flexible installation. The preferred fastener would also have the ability to secure multiple layers of screens with one fastening device. In this way, plastic, nylon or other desired material can be edged with a screen-like material and then engaged between the attachment pads along with the screen so the screen can be covered when desired. For these and other reasons, there is need for a fastening device that incorporates a single screen or multiple screens between interlocking components.

SUMMARY OF THE INVENTION

It is an object of the present invention to provide a fastening device that securely engages a woven screen or multiple layers of woven screen between two opposing attachment pads, one pad having projecting stems and another pad formed with openings and receptacles that engage the stems.

It is another object of the invention is to provide a fastening device that is easy to use, versatile and economical, providing secure fastening.

Yet another object of the present invention is to provide a fastening device that allows for attachment to overlapping woven screen material and for attachment to abutting edges of multiple screens sections.

Another objective is to provide a fastening device that is easily connected to a supporting structure without affecting the connection to the woven screen mesh.

These and other features, aspects and advantages of the present invention will become better understood with reference to the following description and appended claims.

In realizing these and other advantages and objectives of the invention a fastening device according to the present invention includes a first pad having a first face, from which face, mutually-spaced stems project in an ordered arrangement; and a second pad having a second face formed with mutually-spaced openings, and formed with receptacles, each receptacle extending from an opening into the second pad, each stem located and sized for insertion through an opening into a receptacle.

BRIEF DESCRIPTION OF THE DRAWINGS

The figures listed below have been selected to illustrate a preferred embodiment of the present invention. These figures along with the accompanying description are sufficient for those skilled in the art to practice the invention as claimed.

Figure 7:
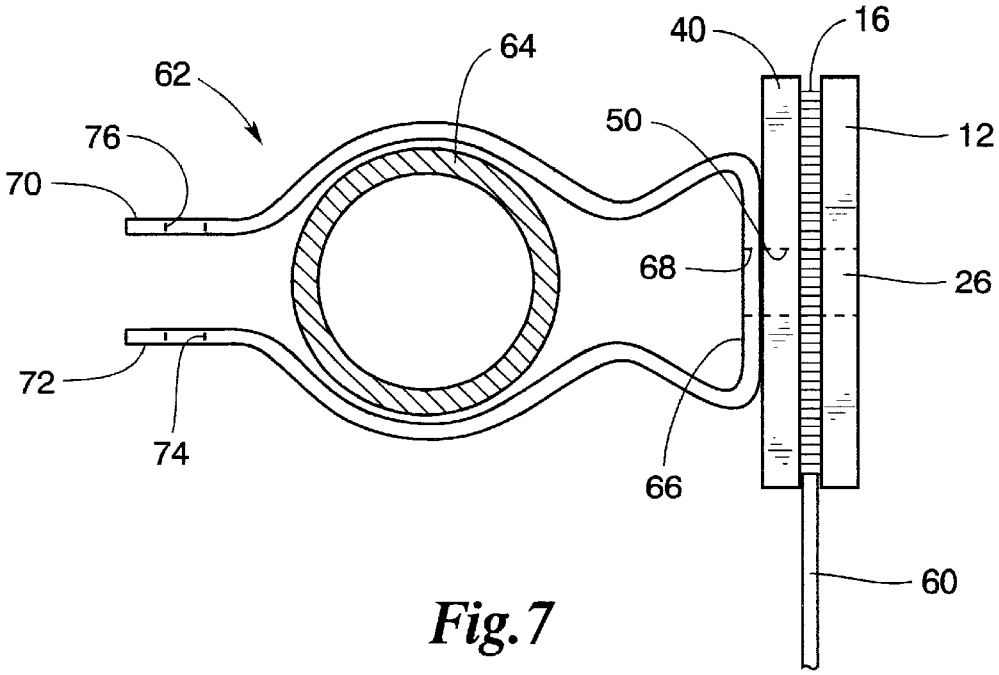

FIG. 7 is a side view of an attachment bracket for connecting a screen and the attachment pads to a support.

Figure 8:
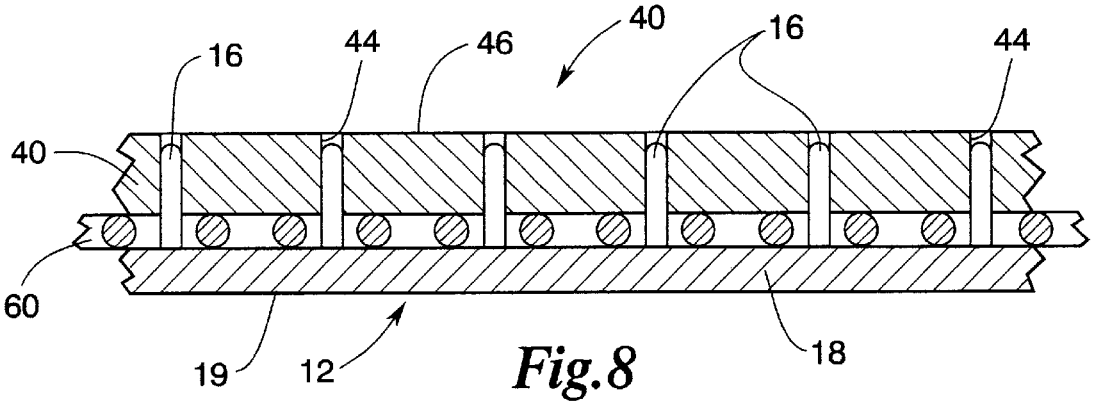

FIG. 8 is a partial cross section of an assembly that includes a woven screen and the attachment pads.

Figure 9:
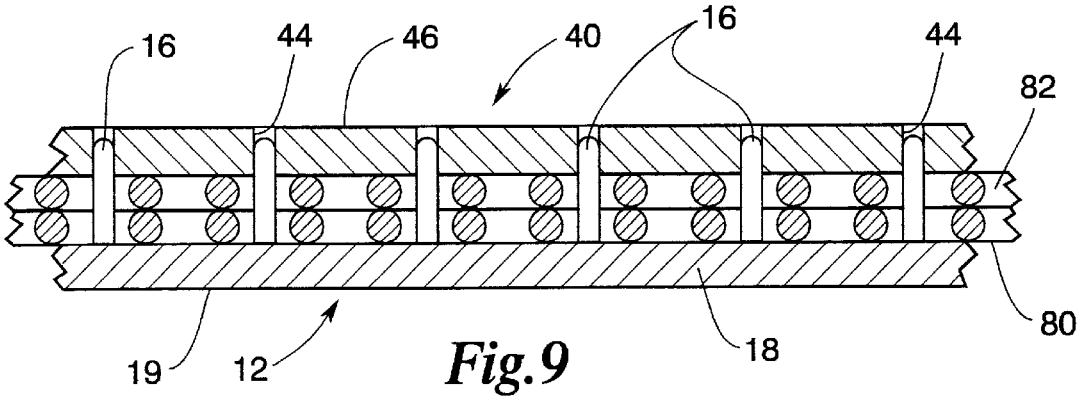

FIG. 9 is a partial cross section of an assembly that includes a double thickness of woven screen and the attachment pads.

DESCRIPTION OF THE PREFERRED EMBODIMENT

Figure 1:
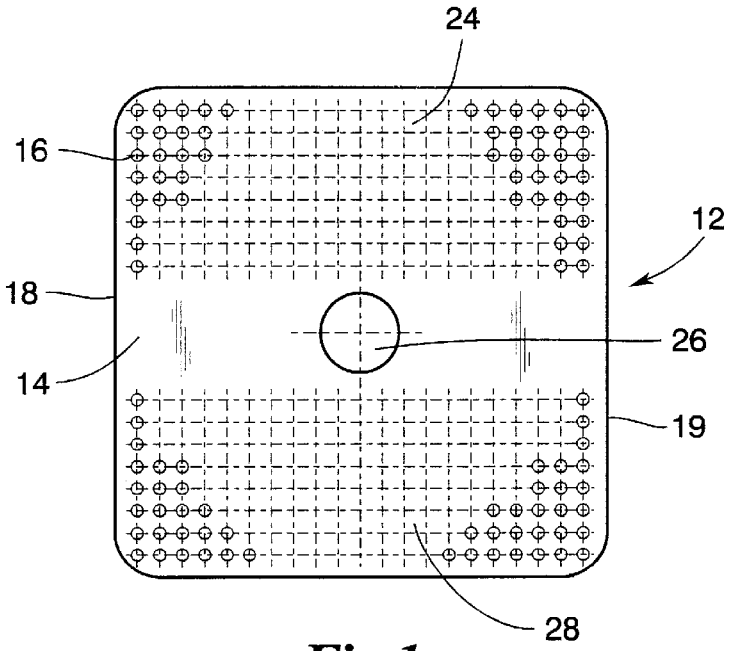
FIG. 1 is a top view of a first attachment pad.
Figure 3:
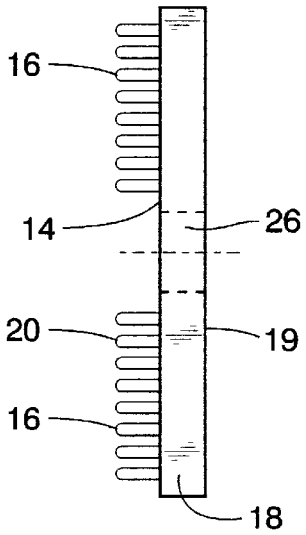
FIG. 3 is an end view of the pad of FIG. 1.
Figure 2:
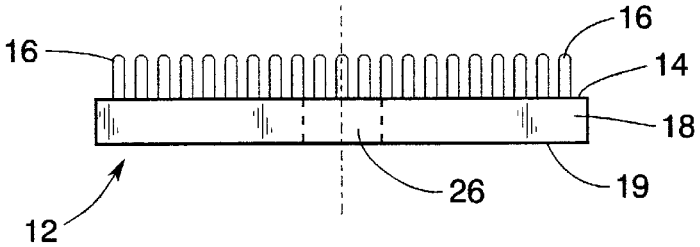
FIG. 2 is a front view of the pad of FIG. 1.

Referring first to FIGS. 1–3, a fastening device 10 according to this invention includes a first attachment pad 12, rectangular in planform and having a planar inner face 14, from which face stems or fingers 16 project and are arranged in a mutually-spaced, ordered arrangement, preferably in rows extending longitudinally and columns extending laterally. The base 18 of the pad preferably has a planar outer face 19.

The pad 12 and stems 16 are preferably of integrally molded plastic. Each stem is relatively slender, i.e., narrow in circumference or width in proportion to its length or height. Each stem is preferably in the form of a right circular cylinder projecting perpendicularly from the face 14; however, the stems may have any suitable form and cross sectional shape. Preferably the tip of each stem is somewhat reduced in cross sectional area as compared to its area below the tip and along its length. For example, when the stem has the shape of a circular cylinder, the tip may be formed with a spherical radius 20. In this way, the tip provides a lead that facilitates entry of the stem into an opening. The properties of the material of the pad and stem, and the length and cross sectional size of each stem provide sufficient bending flexibility to allow each stem to readily align with an opening contacting at the stem tip. Yet each stem has sufficient bending stiffness to remain substantially erect under the effect of a force applied to the outer surface 19 of pad 12 and a force resisting entry of the stems into an opening.

The stems are arranged in a first group 24 located on one side of a central hole 26 and a second group 28 located at the opposite side of the hole, which passes entirely through the thickness of the pad 12.

Figure 4:
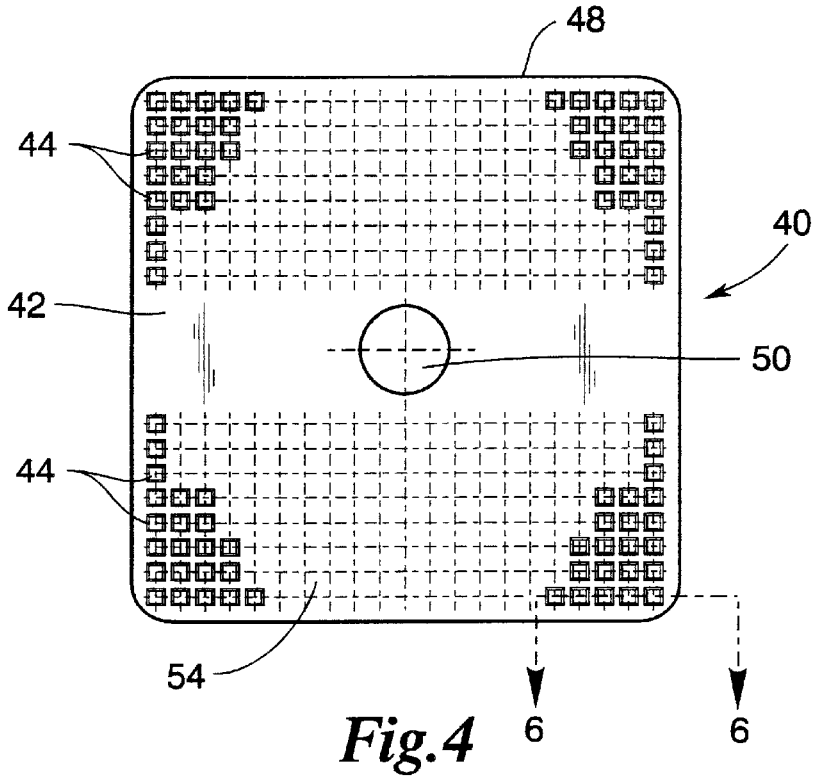
FIG. 4 is a top view of a second attachment pad.
Figure 5:
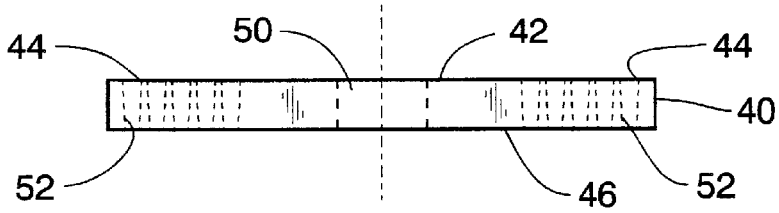
FIG. 5 is a front view of the pad of FIG. 4.

FIGS. 4 and 5 show a second attachment pad 40, rectangular in planform and having a planar inner face 42 formed with openings 44, arranged in a mutually-spaced, ordered arrangement, preferably in rows and columns corresponding in position to the position of the stems 16. The second pad 40 preferably has a planar outer face 46.

The openings 44 are arranged in a third group 48 located on one side of a central hole 50 and a fourth group 54 located at the opposite side of the hole, which passes entirely through the thickness of second pad 12. Each stem 16 of the first pad 12 is aligned with an opening 44 located on the inner face 42 of the second pad 40. When the stem and openings are so aligned, the centrally located holes 26, 50 on the pads 12, 40 are aligned also. Each opening 44 is sized to allow a stem 16 to pass through the opening into a receptacle 52, formed in the thickness of the second pad 40 adjacent the opening.

Figure 6:
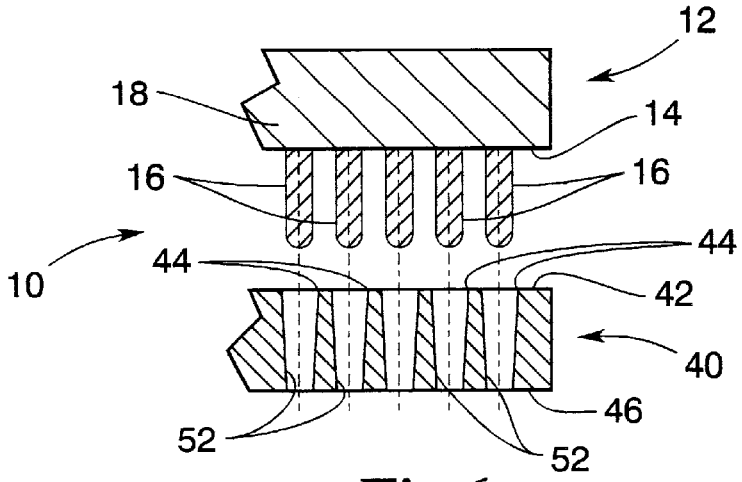
FIG. 6 is partial cross section through the openings and receptacles of the second attachment pad taken at plane 6—6 of FIG. 4, with aligned stems of the first attachment pads also shown in cross section.

FIG. 6 is a cross section view through pad 40 and pad 12 showing a preferred configuration of the openings 44, receptacles 52, and stems 16. Each receptacle extends from an opening into the thickness of the second pad 40. The receptacle may be tapered through the pad thickness, the cross sectional area of a receptacle becoming smaller as distance along its length through the thickness of the pad 40 increases from the inner face 42 to the outer face 46. Alternatively the receptacles can have a uniform cross sectional area along their length, preferably sized so that there is a slight interference fit between the sides of the receptacles and the sides of the stems. In this way, the resilient, elastic material of the stems will frictionally engage the receptacles to prevent the stems from inadvertently sliding out of the receptacles, yet allow intentional removal of the stems from the receptacles.

FIG. 7 is a side view of a mounting bracket 62 suited to connect the screen 60 and attachment pads 12, 40 to a support, such as a fence rail 64. The bracket is preferably of stamped, bent sheet metal formed with a mounting flange 66 having a central through-hole 68. The bracket has two legs 70,72, which straddle the fence rail and are clamped to the rail by a fastener passed through the aligned holes 74, 76 on the legs. The attachment pads are shown with the screen 60 carried on the stems, which are fitted within the receptacles in the assembled position. The central holes 26, 50 formed through the attachment pads are aligned mutually and with the hole 68 of the bracket. An attachment bolt can be passed through these three holes to fix the screen and attachment pads to the fence rail. However, the pads can be directly connected to a support by driving a connector through holes 26, 50 into the support, without use of a bracket.

The mesh of the screen material 60 represents the number of openings between stands of the screen weave per unit length of the screen, the mesh having rectangular or square weave openings. The optimum mesh size is 18×14, which indicates eighteen screen openings longitudinally and fourteen screen openings laterally per inch of screen material length in those mutually perpendicular directions. Of course other screen mesh sizes can be used, provided that the mesh substantially corresponds with the spaced relationship of the stems 16 and openings 44 of the attachment pads 12, 40, respectively. The screen material 60 can be a rigid material such as metal, or it can be a flexible material such as plastic, but it is not limited to either of these.

As seen in FIG. 8 a fastened assembly includes the attachment pads 12, 40 and screen material 60 having a mesh that is spaced and sized to receive a stem that passes through a corresponding mesh of the screen material.

To use the fastening device with only a single piece or thickness of screen material, the screen material 60 is located facing and near to the inner face of the first pad, and the stems are inserted through the mesh of the screen by applying pressure to the outer surface of the pad 12. Next, each stem on the first pad is aligned with an opening 44 on the second pad. Then force is applied in opposite directions to the outer surfaces 19, 46 of the first and second pads 12, 40 sufficiently to insert the stems 16 through the openings 44 and into the corresponding receptacles 52 of pad 40, thereby attaching the first and second pads to the screen 60. The screen and attached pads are positioned adjacent the bracket 62 such that the central holes 26, 50 of the pads and the hole 68 of the bracket are aligned. An attachment is inserted though the three aligned holes to releasably secured the screen 60 to the bracket. Finally, the screen is supported on a fence or other supporting structure by attaching the bracket to the support at any suitable location, as shown in FIG. 7.

The fastening device can be used also to connect two pieces of screen material by abutting their adjacent free edges at the location of the pads, or by overlapping short lengths of the screen material at the edges of the material pieces. To abut the edges, the screen material of a first piece of screen is located over the inner face 14 of the first pad 12 such that the screen edge is located near the centerline of the hole 26, and the stems of the first group 24 of stems 16 are inserted through the mesh of that screen material by applying pressure to the outer surface 19 of the pad 12. Similarly, the screen material of the other piece of screen material is located over the inner face of the first pad such that the screen edge is located near the centerline of the hole 26, and the stems of the second group 28 of stems are inserted through the mesh of the second screen material by applying pressure to the outer surface 19 of the pad 12. Next, each stem 16 on the first pad is aligned with an opening 44 on the second pad 40. Then, force is applied in opposite directions to the outer surfaces 19, 46 of the first and second pads sufficiently to insert the stems through the openings and into the corresponding receptacles 52 of pad 40, thereby attaching the first and second pads to the screen. The screen and attached pads are positioned adjacent the bracket 62 such that the central holes of the pads and the hole of the bracket are aligned. An attachment is inserted though the three aligned holes to releasably connect the attachment pads to the bracket. Finally, the screen is supported on a fence rail or other supporting structure by attaching the bracket to the support fence at any suitable location.

FIG. 9 shows the fastening device used to connect a double thickness or two pieces 80, 82 of overlapping screen material. Both screen pieces are located over the inner face of the first pad, and the stems of the first and second groups 24, 28 of stems are inserted through the mesh of both screen materials by applying pressure to the outer surface of the pad 12. Next, each stem on the first pad is aligned with an opening on the second pad. Then, force is applied in opposite directions to the outer surfaces of the first and second pads sufficiently to insert the stems through the openings and into the corresponding receptacles 52 of pad 40, thereby attaching the overlapping screen portions to the attachment pads. The screens and attached pads are positioned adjacent the bracket 62 such that the central holes 26, 50 of the pads and the hole 68 of the bracket flange 66 are aligned. An attachment is inserted though the three aligned holes to releasably secured the attachment pads to the bracket. Finally, the screens are supported on a fence or other supporting structure by attaching the bracket to the support at any suitable location.

In any of the described assemblies, once the screen material is engaged between the attachment pads 12, 40, the screen and pads can be fastened on any structure at any desired location, without use of the bracket. For example, the screen can be supported by attaching the pads to a structural member using clips, staples, screws, bolts or nails driven through the aligned holes into the structure. Alternatively, the outer face of an attachment pad can be coated with a sticky adhesive, which would bond to an appropriate surface of the supporting structure, thereby supporting the screen.

Materials other than woven screen, such as a woven, knit or knotted material of open texture having holes, preferable evenly spaced holes such as those of a screen or net, can be secured between the pads by passing the stems through the mesh and into the receptacles.

The previously described versions of the present invention have many advantages, including easier and more secure positioning of screens in openings, such as windows, and less burdensome maintenance and cleaning of the screen. Also, multiple screens can be joined together by the fastening device so that the covering can be enlarged to accommodate different sized openings. Multiple screens can be used simultaneously by the fastening device so that the original screen can be covered to prevent water, dirt or inclement weather from entering a structure, to prevent small insects from infiltrating the screened enclosed area, and to provide visual privacy. The invention is very easy to use, versatile, reusable, reclosable and economical.

Although the form of the invention shown and described here constitutes the preferred embodiment of the invention, it is not intended to illustrate all possible forms of the invention. Words used here are words of description rather than of limitation. Various changes in the form of the invention may be made without departing from the spirit and scope of the invention as disclosed.

I claim:

1. A fastening device, comprising:

a first pad having a first face, from which face, mutually-spaced stems project in an ordered arrangement;

a second pad unconnected to the first pad when unfastened, the second pad having a second face formed with mutually spaced openings, and formed with receptacles, each receptacle extending from an opening into the second pad, each stem located and sized for insertion through an opening into a receptacle for engagement therebetween;

a screen material comprising a weave corresponding in substantial space relation with the stems, a portion of the screen being engaged between the first pad and the second pad with each stem passing through a mesh of the weave before passing through the corresponding opening and into the receptacle thereof; and wherein the second face is substantially planar, the second pad has a fourth face substantially parallel to the second face, the second and fourth faces are located on opposite sides of a thickness of the second pad, each receptacle having a length extending substantially perpendicularly from an opening into said thickness.

2. The device of claim 1, wherein each receptacle extends through said thickness from an opening to the fourth surface, and each receptacle has a rectangular cross sectional shape.

3. The device of claim 2, wherein each receptacle has a cross sectional area that decreases as the length of the receptacle increases into said thickness.

4. The device of claim 1, wherein:

the first face is substantially planar, the stems are arranged in rows and columns in uniformly mutually-spaced relation on the first face, the stems project substantially perpendicularly from the first face; and the second face is substantially planar, each receptacle extends substantially perpendicularly from an opening into the second pad, and the receptacles are arranged in rows and columns on the second face.

5. The device of claim 4, wherein:

the stems are arranged in uniformly mutually-spaced relation on the first face in first and second groups of rows and columns; and the receptacles are arranged in uniformly mutually spaced relation on the second face in third and fourth groups of rows and columns, the stems of the first group being aligned with the receptacles of the second group, the stems of the third group being aligned with the receptacles of the fourth group.

6. The device of claim 1, wherein:

the first pad is formed with a first hole that extends through the thickness of the first pad; and the second pad is formed with a second hole that extends through the thickness of the second pad, the second hole being aligned with the first hole when the stems are aligned with the corresponding openings.

7. The device of claim 6, further comprising:

a bracket adapted for attachment to a supporting structure, the bracket formed with a third hole that is aligned with the first and second holes; and an attachment inserted through the hole of the bracket, the first hole and second hole for connecting the bracket to the first pad and second pad.

8. A fastening assembly, comprising:

a first pad having a first face, from which face mutually-spaced stems project in an ordered arrangement, the first pad is formed with a first hole that extends through the thickness of the first pad;

a second pad having a second face formed with mutually-spaced openings, the second pad being formed with receptacles, each receptacle extending from an opening into the second pad, each stem located and sized for insertion through an opening into a receptacle for releasable engagement therewith, the second pad is formed with a second hole that extends through the thickness of the second pad, the second hole being aligned with the first hole when the stems are aligned with the corresponding openings;

a screen having a mesh, the stems projecting through a portion of the mesh and openings and into the receptacles, thereby securing the screen to the first pad and second pad;

a bracket adapted for attachment to a supporting structure, the bracket formed with a third hole that is aligned with the first and second holes; and an attachment inserted through the hole of the bracket, the first hole and second hole for connecting the bracket to the first pad and second pad.

9. The assembly of claim 8, wherein the first pad is unconnected to the second pad when unfastened and the screen comprising a rectangular weave having a mesh corresponding substantially with the spaced arrangement of the stems, the screen being engaged between the first pad and second pad, each stem passing through a mesh of the screen and having a length greater than the thickness of the screen and sufficient for insertion through an opening into a receptacle.

10. A fastening assembly, comprising:

a first pad having a first face, from which mutually-spaced stems project in an ordered arrangement comprising a first group of stems and a second group of stems spaced from said first group; and a second pad facing the first pad, having a second face formed with mutually-spaced openings, the second pad being formed with receptacles, each receptacle extending from an opening into the second pad, the openings and receptacles arranged in a third group and a fourth group spaced from said first group, each stem located and sized for insertion through an opening into a receptacle, the stems of the first group being aligned with the openings of the second group, the stems of the third group being aligned with the receptacles of the fourth group;

a first screen having a first mesh, the first group of stems projecting through a portion of the first mesh, the openings of the third group and into the receptacles of the third group; and a second screen having a second mesh, the second group of stems projecting through a portion of the second mesh, the openings of the fourth group and into the receptacles of the fourth group.

11. The assembly of claim 10, wherein:

the first pad is formed with a first hole that extends through the thickness of the first pad between said first group and said group; and the second pad is formed with a second hole that extends through the thickness of the second pad between said third group and said fourth group, the second hole being aligned with the first hole when the stems are aligned with the corresponding openings.

12. The assembly of claim 11, further comprising:

a bracket adapted for attachment to a supporting structure, the bracket formed with a third hole aligned with the first and second holes; and an attachment inserted through the hole of the bracket, the first hole and second hole for connecting the bracket to the first pad and second pad.

13. A method for attaching screen material with a mesh using a first pad having stems projecting in an ordered, mutually-spaced arrangement from an inner surface, and a second pad having an inner surface formed with openings and receptacles arranged to align with the stems, each receptacle extending from an opening into the second pad, the first pad and second pad having a bracket attachment mechanism, comprising the steps of:

inserting the stems through the mesh of a screen;

aligning each stem on the first pad with an opening on the second pad and simultaneously arranging the bracket attachment mechanism;

applying force in opposite directions to the outer surfaces of the aligned first and second pads sufficiently to insert the stems through the openings and into the corresponding receptacles, thereby securing the first and second pads to the screen;

attaching a bracket at the location of the first and second pads to a supporting structure; and connecting the first and second pads to the bracket by the arranged attachment mechanism.

14. A method for attaching screen material using a first pad having stems projecting group from an inner surface in an ordered spaced arrangement comprising a first group of stems and a second group of stems spaced from said first group, and a second pad having an inner surface formed with openings arranged to align with the stems, and receptacles, each receptacle extending from an opening into the second pad, the openings and receptacles arranged in a third group and a fourth group, the stems of the first group being aligned with the openings of the third group, the stems of the second group being aligned with the receptacles of the fourth group, comprising the steps of:

inserting the first group of stems through the mesh of a first screen;

inserting the second group of stems through the mesh of a second screen;

aligning each stem of the first group with an opening of the third group;

aligning each stem of the second group with an opening of the fourth group; and applying force in opposite directions to the outer surfaces of the first and second pads sufficiently to insert the stems through the openings and into the corresponding receptacles, thereby attaching the first and second pads to the screens.

15. The method of claim 14, further comprising:

securing a bracket at the location of the first and second pads to a supporting structure; and connecting the first and second pads to the bracket.

* * * * *